United States Patent [19]

Seidel

[11] 4,351,537

[45] Sep. 28, 1982

[54] MULTIPART SKATE

[75] Inventor: Sigurd Seidel, Graz, Austria

[73] Assignee: Warrington Inc., Mississauga, Canada

[21] Appl. No.: 112,686

[22] Filed: Jan. 16, 1980

[30] Foreign Application Priority Data

Jan. 19, 1979 [AT] Austria ..... 421/79

[51] Int. Cl.[3] ..... A63C 1/00

[52] U.S. Cl. ..... 280/11.12; 36/115; 280/11.3; 280/811

[58] Field of Search ..... 280/11.3, 11.12, 11.18, 280/811, 11.36; 36/115

[56] References Cited

U.S. PATENT DOCUMENTS

| | | | |
|---|---|---|---|
| 998,605 | 7/1911 | Dorsey | 280/11.3 |
| 1,714,760 | 5/1929 | Bloomberg | 280/811 |
| 1,986,580 | 1/1935 | Johnson | 36/115 X |
| 3,806,145 | 4/1974 | Czeiszperger | 280/811 |
| 3,829,111 | 8/1974 | Nicholls | 280/11.3 |
| 3,939,583 | 2/1976 | Daumann | 280/11.3 X |
| 4,053,168 | 10/1977 | Goverde | 280/11.12 |
| 4,085,944 | 4/1978 | Chambers | 280/11.12 |
| 4,107,856 | 8/1978 | Borque | 280/11.36 X |
| 4,223,900 | 9/1980 | Olivieri | 280/11.12 |

FOREIGN PATENT DOCUMENTS

| | | | |
|---|---|---|---|
| 308590 | 7/1973 | Austria . | |
| 328347 | 3/1976 | Austria . | |
| 921697 | 2/1973 | Canada | 36/115 |
| 1485627 | 3/1970 | Fed. Rep. of Germany . | |
| 1810291 | 6/1970 | Fed. Rep. of Germany . | |
| 1962632 | 6/1971 | Fed. Rep. of Germany . | |
| 2638643 | 3/1977 | Fed. Rep. of Germany . | |
| 2724140 | 12/1977 | Fed. Rep. of Germany . | |
| 165081 | 10/1958 | Sweden | 280/11.12 |
| 553550 | 9/1974 | Switzerland . | |

*Primary Examiner*—Richard A. Bertsch
*Assistant Examiner*—Milton L. Smith

[57] ABSTRACT

A skate boot for use with a hockey skate. The boot has a molded support structure. The support structure includes a portion which is the sole of the boot and first and second support portions for supporting a steel runner. Attached to the molded support structure is a soft flexible sock adapted to receive the skater's foot. A removable cover portion is adapted to meet with the molded support structure to fully enclose the sock and to thereby provide protection for the skater's foot. The cover includes fastening means which fasten under the sole portion and behind the ankle of the skater such that the cover and the molded support structure provide an integral unit when assembled.

12 Claims, 13 Drawing Figures

MULTIPART SKATE

This invention relates generally to improvements in skate boots for use with ice skates and has to do particularly with the construction of the boot and skate supporting structure.

Many forms of boots have been adapted for use with ice skates. The boots normally comprise some form of foot enclosing structure manufactured from leather or synthetic materials adapted to replace leather. The usual boot comprises a sole portion which serves to provide a rigid support for the sole of the foot and also to provide a rigid platform to which the lower supporting structure may be mounted. The lower structure affixed to the sole portion can comprise either metallic or molded structures attached typically to the heel portion and to the front or ball portion of the foot to which is attached a runner.

As with all skates the fit of the boot to the foot of the wearer is of considerable importance. Firstly, the boot must fit the foot of the wearer so as to be comfortable so that it may be worn for extended periods. In addition, the boot must firmly support and hold the foot so that the foot maintains uniform contact with the sole of the boot. It has been observed that with many existing boots a certain amount of movement of the foot relative to the sole of the boot is permitted in conventional constructions particularly in the area of the heel of the foot. This movement between the foot and the runner supporting structure is objectionable. Ideally, the wearer's foot should be in intimate contact with the surface on which the boot is being used. With particular reference to a hockey skate the boot must be formed of a sufficiently stiff material so as to protect the wearer from blows arising from contact with the skates of other players or from sticks, pucks, hockey rink boards or the like. In conventional such boots, the foot enclosing portion accomplishes both the fit function and the protection function. In order to have a single structure accomplishing both functions, each function is somewhat compromised.

Accordingly, it is an object of the present invention to provide a boot which will comfortably fit the wearer's foot while at the same time maintaining close and firm contact between the wearer's foot and the sole of the skate so as to minimize any movement between the foot of the wearer and the skate supporting structure. In addition, it is an object of this invention to provide a skate which is suitably stiff and protective of the wearer's foot so that it may be used in contact sports such as ice hockey.

According to the invention a skate for use as an ice skate comprises a rigid support structure, a sock and a removable cover adapted to cooperate with the support structure to enclose the sock; the rigid support structure comprising a sole portion, and first and second support portions; the sock which is relatively soft and flexible is adapted to receive the skater's foot and is adapted to be affixed to the sole portion.

An embodiment of the invention for use particularly as an ice hockey skate is illustrated in the accompanying drawings in which like numerals denote like parts throughout the several views, and in which.

Figure 1:
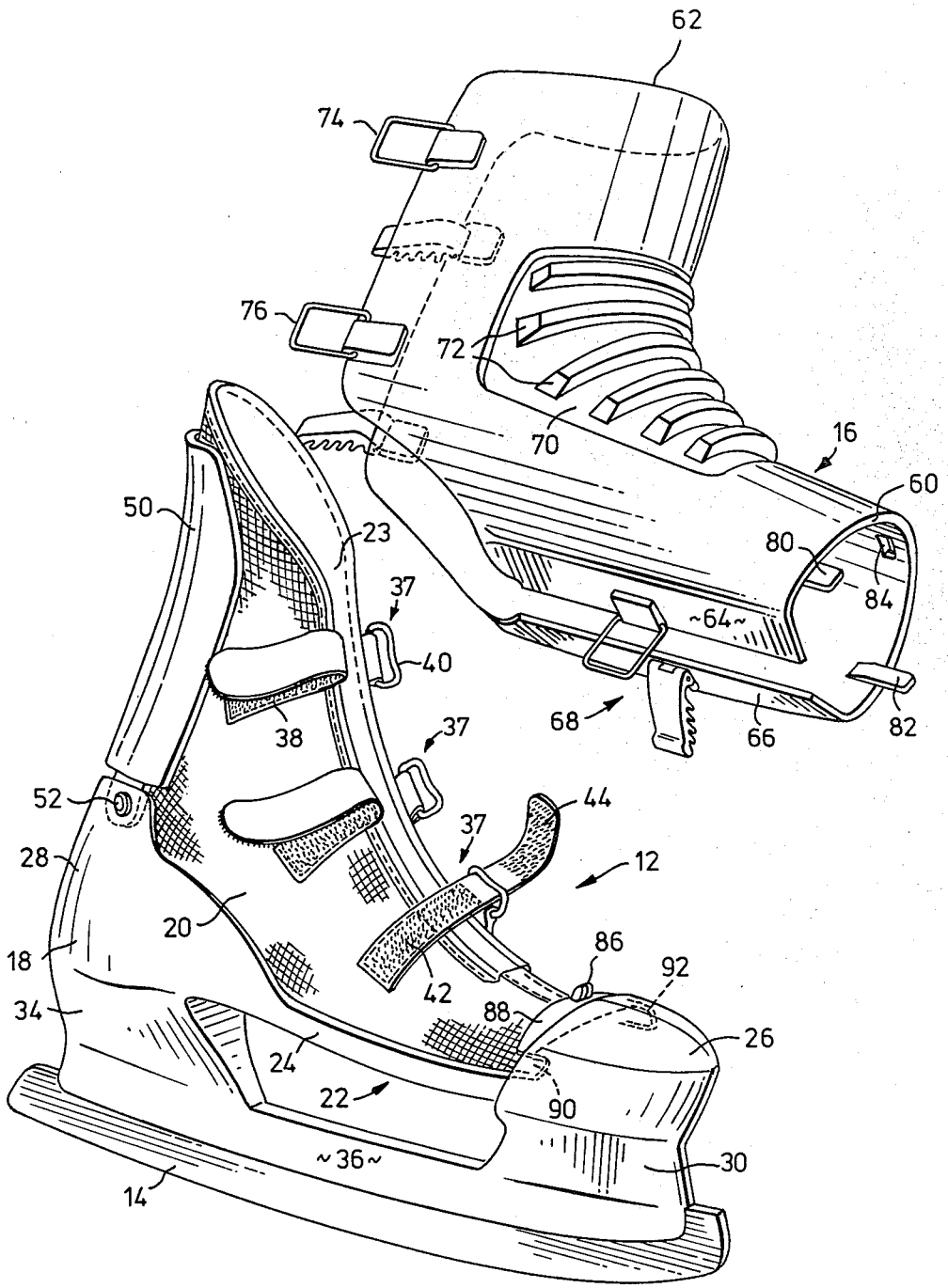
FIG. 1 is an isometric view of an ice skate illustrating the two separate parts of the ice skate in the unassembled condition.
Figure 2:
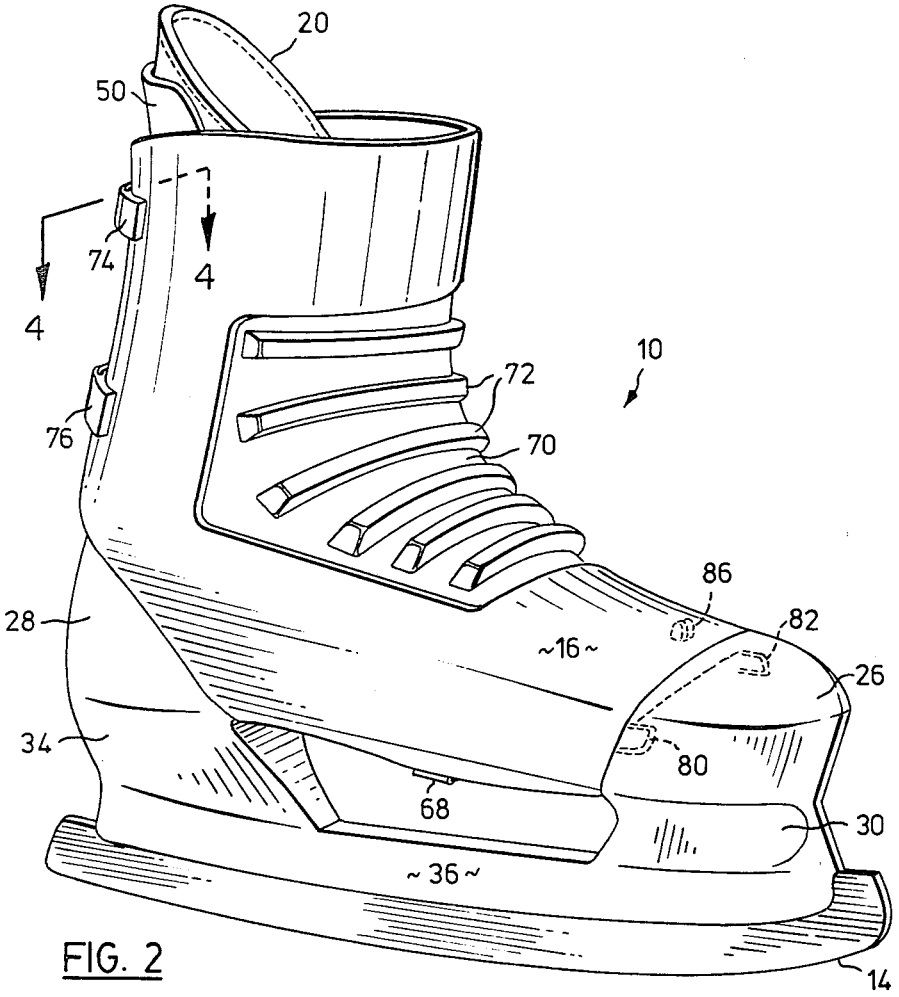
FIG. 2 illustrates the skate of FIG. 1 in the assembled condition.

Turning to the figures, there is illustrated in FIGS. 1 and 2 an ice hockey skate 10 including a boot indicated generally as 12, a steel runner 14 and a cover 16. The boot 12 comprises a molded support structure 18 and a soft flexible foot enclosing portion or sock 20. The sock 20 is intended to comfortably enclose the foot of the wearer and may be manufactured from any suitable material such as leather. Various forms of synthetic materials may also be used such as nylon woven materials, etc. The molded support structure 18 of the boot will be discussed hereafter in greater detail and may be manufactured from a relatively stiff material having sufficient structural strength to support the weight of the wearer on the steel runner 14. The material may be either a nylon based zytel or a polycarbonate material such as Lexan (Trade Mark of General Electric). The cover 16 may be manufactured from any material which is sufficiently stiff to provide protection against the various forms of impact to which an ice hockey skate may be expected to be exposed while still having a degree of flexibility for the purposes to be discussed hereinafter in greater detail. It is suggested that the cover 16 may be manufactured from a polyurethane or any of the well-known thermoplastic rubber compositions. The cover 16 may also be manufactured from nylon derivative materials such as that identified by the Trade Mark Surlyn.

Molded support structure 18 is illustrated in FIGS. 1 and 2 most clearly. The support structure comprises a relatively flat portion 22 comprising the sole of the boot. The sole 22 extends the full length of the boot and turns up at each lateral edge of the skate to form a lip 24 which is illustrated in FIG. 1. The end portions of the support structure 18 comprise a toe enclosing portion 26 and a heel enclosing portion 28.

The toe enclosing portion 26 comprises the toe of the skate and extends upwardly over the top of the toes of the foot when placed inside the boot. The toe portion 26 of the support structure 18 thus provides complete security for the toes of the wearer as would be required with a hockey skate. The toe portion 26 also extends downwardly toward the runner in a first support portion 30.

The rear portion of support structure 18 comprises the heel enclosing portion 28 which is visible in FIG. 1. The heel enclosing portion 28 extends around the back of the skate boot to provide protection for the heel from the back of the skate and around to either side. It will be observed that portion 28 extends upwardly and rearwardly from the lip 24 commencing just aft of the location of the arch of the foot of the wearer. The heel enclosing portion 28 also extends downwardly toward the runner in a second support portion 34. Support portions 30 and 34 depending from the toe and heel portions respectively extend downwardly to a blade portion 36 of the support structure 18. Blade portion 36 extends longitudinally of the skate and is molded integrally with the remainder of support structure 18 to provide a single structurally sound molded unit. The means for mounting the steel blade 14 of the ice skate in the blade portion 36 of the support structure will be described hereinafter in greater detail.

The sock 20 is intended to comfortably enclose the foot of the wearer. For this purpose the sock 20 is of a configuration similar to a conventional boot and comprises a central opening 23 extending along the upper surface thereof from the toe to the top to allow the foot to be inserted into the sock 20 from the top. The sock 20 may advantageously comprise a full foot enclosing structure. Thus, the heel and toes of the wearer may be encapsulated within the sock 20. In certain instances it may be desirable to leave the sock open at the toe and heel to permit the toes and heel of the wearer to project from the sock. In either case, the wearer's toes and heel will project into toe enclosing portion 26 and heel enclosing portion 28 respectively. Ideally, the sock 20 will also comprise padding in the bottom surface thereof so as to comfortably support the foot against the sole portion 22 of support structure 18.

The sock 20 may be attached to molded portion 18 by any conventional means. Thus, the sock 20 may be attached to the sole 22 by means of rivets or by means of gluing. One additional advantage of using a nylon based material for the support structure 18 and a nylon woven material for the sock is that the two nylons may be ultrasonically welded together. It is suggested that use of such materials leads to a particularly advantageous process for permanently affixing the sock 20 to the support structure 18.

Figure 12:
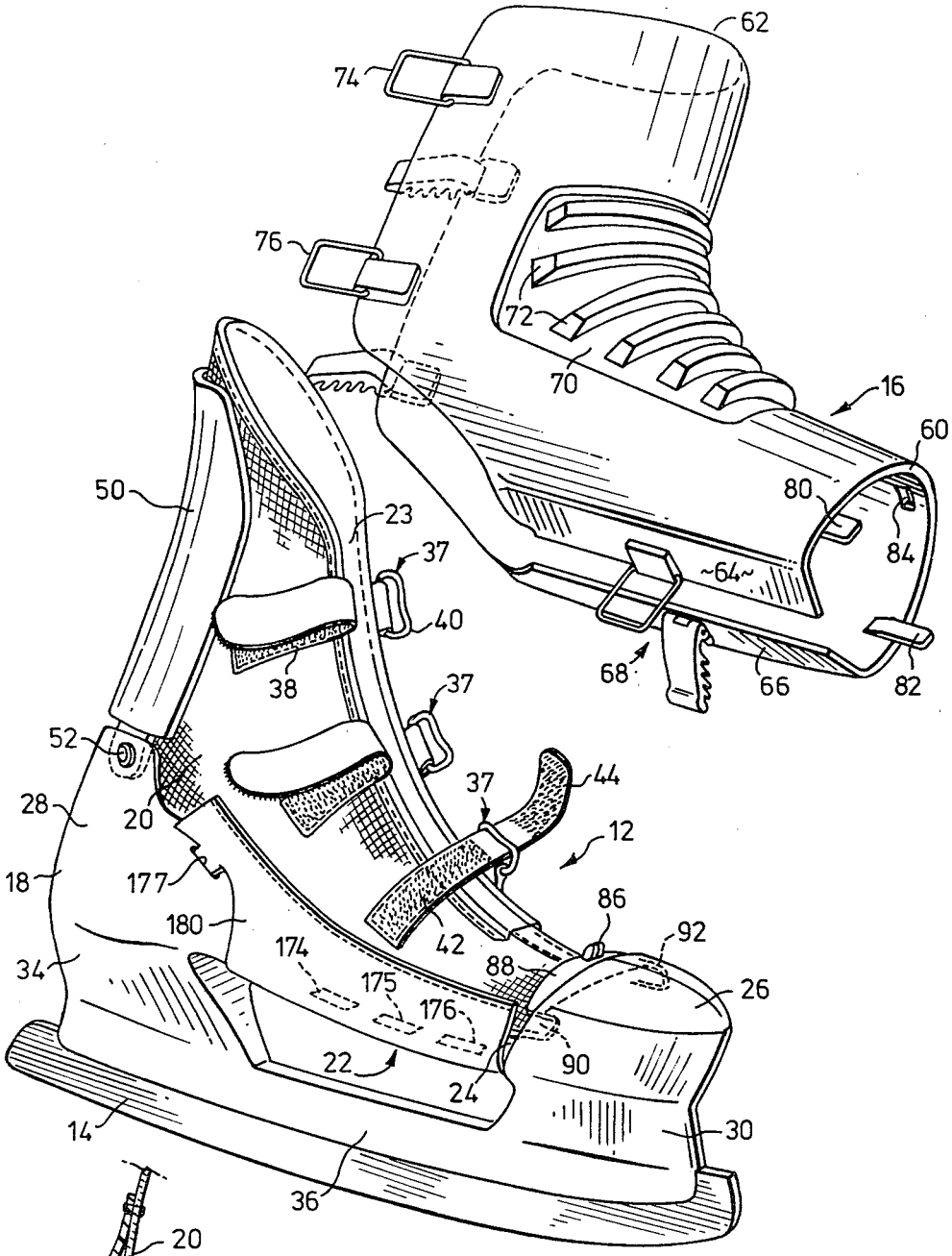
FIG. 12 illustrates an alternative embodiment of the skate in FIG. 1 having a detachable sock.
Figure 13:
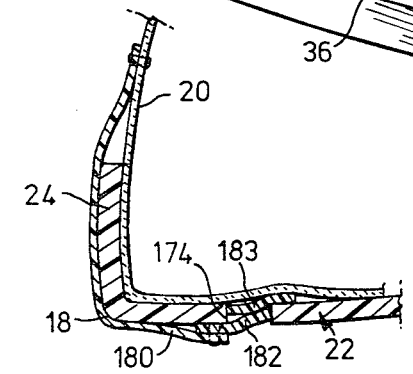
FIG. 13 is a vertical part section of the embodiment of FIG. 12 illustrating the fastening means.

In certain instances it may be preferable to detachably affix the sock 20 to support structure 18. This would allow the skater to replace the sock from time to time without the need to replace the support structure or vice versa. A particularly simple means to detachably secure a sock 20 to the support structure 18 is shown in FIGS. 12 and 13. FIG. 12 illustrates a support structure 18 which comprises three slots 174, 175 and 176 through the sole portion 22 close to each lateral edge of the sole portion. In addition, a slot 177 is provided in the heel enclosing portion 28 on each side of the skate.

The sock 20 comprises a pair of flaps 180 and 181 of material similar to the material of the sole 22 or leather or the like. The flaps 180 and 181 may be sewn or otherwise permanently affixed to the sock 20. Each flap comprises a plurality of fasteners adapted to be received by each slot in the support structure 18 to retain the sock. The vertical section illustrated in FIG. 13 illustrates one of the fasteners to be received by the slot 176. At the edge of flap 180 there in sewn or otherwise attached a thin, flat deformable plastic tab 182 as shown. Glued to tab 182 is a second similar tab 183 which is offset as shown. Using the general longitudinal axis of the skate as a reference the proximal edge of tab 182 is spaced from the distal edge of tab 183 a distance equal to the width of the slot as shown. The combined thickness of tabs 182 and 183 is approximately equal to the thickness of the sole portion 22. Thus, the fastener comprising tabs 182 and 183 is snap fitted into the slot and is retained by deforming the two tabs as shown in FIG. 13.

The upper surface of the sock 20 is provided with closure means for closing the sock once the foot of the wearer has been inserted therein. In the embodiment shown, three such closures indicated generally as 37 are shown. In each case the closure 37 may advantageously comprise a strap 38 affixed to one side of the sock on one side of central opening 23 and a loop 40 through which the strap may pass on the other side of central opening 23. The upwardly facing surface of strap 38, as is clearly visible in the lower fastening means 37 illustrated in FIG. 1, comprises the two portions of a Velcro TM fastening system with the receiving portion of the Velcro TM system indicated by numeral 42 and the hook portion indicated by numeral 44. With this system, once the foot of the wearer has been inserted into the sock, the strap 38 is passed through the loop 40 mounted on the other side of the sock and the sock may be held tightly closed over the instep of the wearer by means of the three Velcro TM fastening means. It is suggested that the Velcro TM fastening means illustrated, provide a particularly advantageous and simple form of closure. However, other more conventional forms of closure for the sock, such as a lacing system and the like, may be used. The sock which is soft and flexible may be tightened to the wearer's foot by means of the closures so as to give a very comfortable but intimate fit. Because the sock is not required to protect the foot, it may be made more flexible and softer than a conventional boot, thereby ensuring a very good fit.

Figure 3:
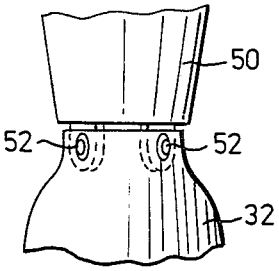
FIG. 3 is a partial view of the rear of the skate shown in FIGS. 1 and 2 and illustrating the means for attaching an Achilles tendon protector to the remainder of the boot.

When the boot is to be used as an ice hockey skate, protection must be given to the Achilles tendon area of the wearer. In order to provide protection for the Achilles tendon area a suitably shaped tendon protector 50 is provided. With reference to FIGS. 1 and 3 it may be seen that the tendon protector 50 is attached to support structure 18 in the vicinity of the upper rear edge of heel enclosing portion 28 by means of a pair of rivets 52. In certain situations it may be considered advantageous to mold the tendon protector 50 integrally with the support structure 18. However, in order to provide a less complicated mold it is considered most advantageous to mold the tendon protector 50 separately and attach it to the supporting structure 18 as shown in these drawings. In either case the tendon protector 50 encircles a like portion of the sock 20 in the area of the Achilles tendon of the wearer.

From viewing FIG. 1 it will be appreciated that in order to wear the skate 10 the skater must first pass his foot downwardly and forwardly into the boot 12 through the central opening 23 in the sock 20. When the wearer's toes are within the toe enclosing portion 26 and the heel is firmly seated in the heel enclosing portion 28, the closures 37 may be closed so that the boot 12 is tightly fitted to the wearer's foot. Once the skate has been partially assembled on the foot of the skater as described above, cover 16 is then assembled to the boot 12.

The cover 16 is a single molded piece comprising a forward portion 60 adapted to mate with toe enclosing portion 26 and a rear portion 62 intended to co-operate with the tendon protector 50 to enclose the ankle of the skater. The cover 16 is open at the back in the area of the Achilles tendon and is open at the bottom in the area of the sole of the boot. Thus, while the material from which cover portion 16 is molded is relatively stiff so as to serve the protective function it is relatively flexible and can be sprung or opened to permit assembly over the boot portion 12 of the skate 10. It will be observed that the portion of cover portion 16 which extends over the instep of the foot terminates in a pair of lower flanges 64 and 66 extending longitudinally of the skate. These flanges are shown in FIG. 1. Closure means indicated generally at 68 are mounted on each of flanges 64 and 66 to fasten the cover 16 in place. Similarly, closure means 74 and 76 are provided at the rear edges of the ankle encircling portion 62 of the cover 16 to provide closure of the cover 16 in the area of the Achilles tendon.

The cover 16 further comprises a more flexible instep portion 70 in the immediate area of the instep of the foot of the wearer. The instep portion 70 is of a material which is much more flexible than the remainder of the cover 16. It is suggested that this instep portion 70 may be manufactured from materials such as leather, nylon, rubber, various forms of microcellular foam including polyurethane or may be injection molded from materials such as polyurethane or thermoplastic rubbers. The flexible portion 70 may be provided with ribs 72 and the like to provide suitable protection for the instep of the foot against impact. The function of the flexible portion 70 is to provide for easy flexing of the ankle. In the course of skating the angle between the shin and the sole of the foot of the skater changes considerably. Accordingly, the cover must be provided with means to allow the ankle of the skater to flex forwardly and rearwardly. Flexible portion 70 ensures that the cover 16 has the desired flexibility.

In order to firmly locate the cover 16 on the boot 12 the front portion 60 of the cover 16 comprises a pair of forwardly extending lugs 80 and 82 on either side of the general central axis of the skate. In addition, a centrally located internal recess 84 is provided in the inside surface of the upward forward portion of the cover portion 12. Recess 84 is adapted to engage upwardly projecting lug 86 at the upper rearward surface of toe enclosing portion 26 of the support structure 18. As can be appreciated from close examination of FIG. 1, lug 86 projects upwardly from a flange-like surface 88 projecting rearwardly from the upper portion of toe enclosing portion 26 of support structure 18. The flange 88 is off-set downwardly from the upper surface of toe enclosing portion 26 and extends around the top of the portion 26 to the edge of a pair of recesses 90 and 92 located on either side of toe enclosing portion 26 just above lip 24. These recesses are shown in dotted lines in FIG. 1 and are sized to co-operate with and receive the forwardly projecting lugs 80 and 82 respectively.

In order to assemble the cover 16 to the remainder of the boot 12 the following procedure is followed. Firstly, the wearer inserts his foot into the boot 12 and closes the closure means 37 as explained above. Thereafter, by grasping the flanges 64 and 66 these flanges are spread apart so as to enable the cover 16 to pass over the instep of the sock 20. The lug 86 is first seated in recess 84 and then the cover 16 is brought forwardly and downwardly to seat each of lugs 80 and 82 in the recesses 90 and 92 respectively. When the three lugs and recesses are seated as explained herein the flange portions 64 and 66 will then be beneath the sole 22 of support structure 28 and between the first support portion 30 and the second support portion 34. By spreading the flanges 64 and 66 apart with the hands of the wearer as suggested above, the rear portion of the cover 16 will also be spread apart allowing the remainder of the cover 16 to be placed around the ankle of the wearer at the same time. Closure means 68 is then used to tightly fasten the cover 16 to the support structure 18 under the sole 22 and betweenn the first support portion 30 and the second support portion 34. Thereafter the two rear closure means 74 and 76 may be fastened in the area of the Achilles tendon to provide the assembled skate, now tightly containing the foot of the wearer.

The assembled skate is shown in FIG. 2. It will be observed from referring to FIG. 2 that the front portion 60 of the cover 16 rests upon the surface 88 so as to ideally provide the skate with a smooth upper surface with no step or off-set between the upper surface of molded portion 26 and the upper surface of the cover 16. It will also be observed from referring to FIG. 2 that the cover 16 has sufficient longitudinal length on each side of the skate so as to overlap the edge of the heel enclosing portion 28 to thereby completely cover the sock 20 which encloses the wearer's foot. As is clearly shown in FIG. 1, the portion of flange 64 that extends outwardly around the second support portion 34 is curved upwardly with the curve being sufficient to ensure that cover 16 fully encloses the sock 20. As can be appreciated from viewing FIG. 2, once the entire skate has been assembled the wearer's foot is entirely enclosed within relatively stiff support structure 18 and cover 16 and is thereby protected. It will also be appreciated that by use of various adjustable closure means the various parts may be molded from their respective materials in processes that do not require exacting dimensional tolerances. For this reason, the various closure means which have been illustrated are all provided with various forms of adjustment.

Figure 4:
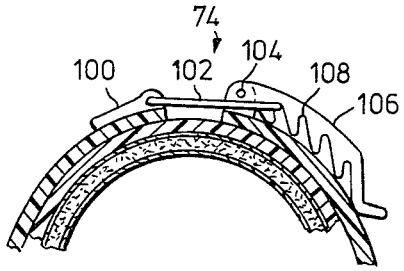
FIG. 4 is a horizontal section in part along the line 4—4 shown in FIG. 2 and illustrating a fastening means.

Reference should be had to FIG. 4 which illustrates one type of closure which may be used in the Achilles tendon area. It will be appreciated that the closure 74 comprises an anchor portion 100 having a wire bail 102 located on one side of the general central axis of the skate. The remainder of the closure 74 comprises a co-operating anchor 104 located on the other side of the cover 16 together with a pivoting toggle 106 having a plurality of grooves 108 therein for adjustably retaining the wire bail 102. It is also suggested that a Velcro TM closure system comprised of straps and loops similar to that shown on the sock 20 could be used in this area. Such a system will provide secure closure and adjustability. Thus, a single molding of cover 16 can be adapted to fit feet of varying widths without requiring different size of covers.

It is suggested that similar types of closures may also be used under the sole 22 as indicated generally at 68. It should be appreciated, however, that closure 68 must be a very tight, effective closure as it is this closure which ensures that the cover 16 is an integral structural part of the support structure 18 when the closure 68 has been fastened. It is, therefore, suggested that some form of over-center buckle be used such that the buckle will not have any tendency to snap open during use.

Figure 5:
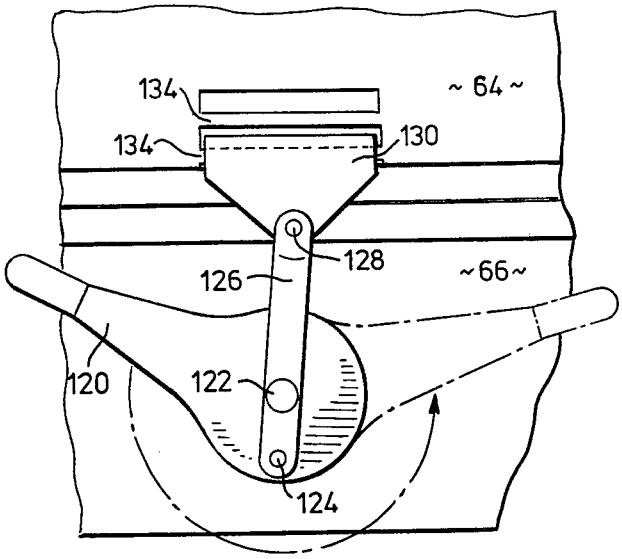
FIG. 5 is a plan view looking upwardly at the sole of the boot and illustrating the closure means for the cover portion of the skate.
Figure 6:
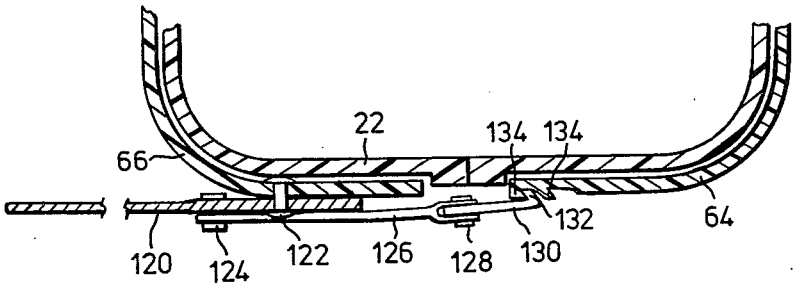
FIG. 6 is a partial vertical section through the boot illustrating the closure of FIG. 5.

A particularly advantageous form of buckle which may be used in place of a simple ski boot type of buckle 68 is shown in FIGS. 5 and 6. FIG. 5 is a plan view looking upwardly at the flanges 64 and 66 of the cover 16 with the cover 16 in place on the skate. Firstly, with reference to FIG. 5 it will be noted that the closure comprises a pivoting lever 120 which is attached to flange 66 by rivet 122. The lever 120 comprises a second pivotal attachment rivet 124 offset from the rivet 122. Rivet 124 pivotally attaches a strap 126 to lever 120. The strap 126 has attached to the end remote thereof from rivet 124, a second rivet 128 which pivotally attaches a retainer cup 130 to strap 126. As is most clearly seen in FIG. 6 the retainer cup 130 comprises an upwardly projecting lip 132. The upwardly projecting lip 132 engages downwardly projecting flanges 134 formed on the surface of flange 64 at the edge thereof.

With reference to FIG. 5 the dotted lines illustrate the closure in the open position. With the closure in the open position rivet 124 will be located adjacent the edge of flange 66 and the strap 126 and cup 130 will be extending towards flap 64. Thus, when the two flanges 64 and 66 are brought into close proximity with one another, the cup 130 may be seated such that its retainer 132 engages one of the flanges 134. Upon rotation of the lever 120 from the dotted line position shown in FIG. 5 to the solid line shown in FIG. 5 about its rivet 122, the rivet 124 will be moved by virtue of the eccentric location to the location shown in full lines in FIG. 5. Thus, the cup 130 is drawn towards flange 66 and will thereby tightly engage against one of the flanges 134 of flange 64 to hold flange 64 in close contact with the sole 22 as shown in FIG. 6. Ideally, the lever 120 should be so located that rivet 124 rotates past the diagonal drawn between rivet 122 and rivet 128 so as to provide an over center form of engagement whereby the buckle will not be accidently opened during use of the skate.

Figure 7:
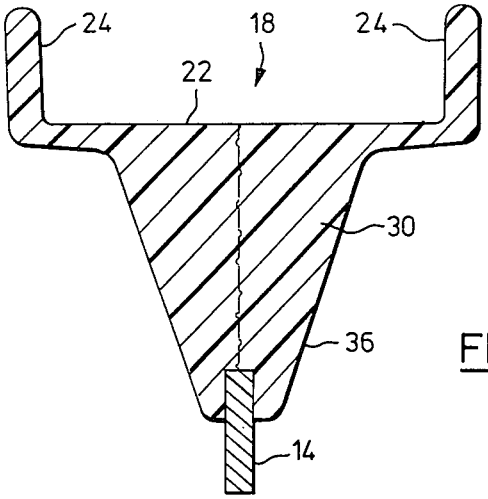
FIGS. 7, 8 and 9 are partial cross-sections of various embodiments of the runner supporting structure illustrating means to attach the steel runner to the support structure.
Figure 8:
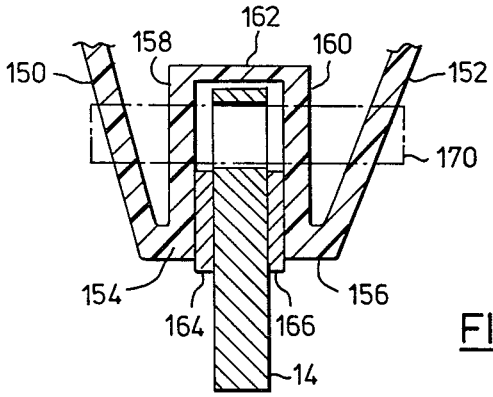
Figure 9:
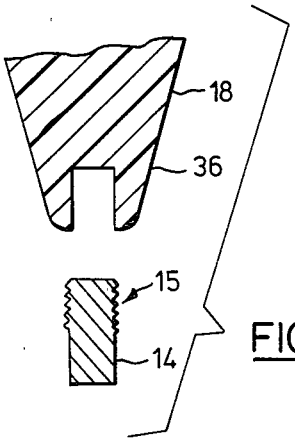

FIGS. 7, 8 and 9 illustrate various vertical cross-sectional configurations of support structure 18 in the vicinity of front support portion 30 and illustrate various methods of retaining the steel runner 14 in the blade portion 36. FIG. 7 illustrates the support structure 18 comprising the sole portion 22 and the flange portions 24. The first support portion 30 has a generally trapezoidal configuration and may be a solid member. At the lower portion thereof the blade portion 36 comprises an extension of the first support portion 30 and terminates in a downwardly turned U-shaped channel. The steel runner 14 may be simply molded into the channel illustrated in the blade portion 36.

FIG. 8 illustrates an alternate form of blade portion 36 for retaining the steel runner 14. In this particular embodiment the first support portion 30 is a hollow structure and comprises a pair of external walls 150 and 152. At the lower end, the walls 150 and 152 extend inwardly toward the general central axis of the skate to provide lower substantially horizontal flanges 154 and 156. Extending upwardly from flanges 154 and 156 are a pair of walls 158 and 160. Walls 158 and 160 are joined at the top thereof by a substantially horizontal wall 162. The steel runner 14 extends upwardly between the vertical walls 158 and 160 adjacent to the horizontal wall 162. Resilient inserts 164 and 166 respectively may be molded directly to the walls 158 and 160 or may be inserted as shims when the steel runner 14 is inserted into the cavity contained between walls 158, 160 and 162. In this construction a pin 170 extends horizontally through all of the walls 152, 160, 158 and 150 respectively and through a suitable hole in the steel runner 14. The pin may be force fitted into the walls 150 and 170 to ensure that the steel runner 14 is firmly retained in its locations. It will be obvious that a plurality of such pins 170 may be provided at convenient locations along the blade 36.

FIG. 9 illustrates a further alternate method of retaining the steel runner 14 in a blade portion 36 which is similar to that shown in FIG. 7. In the embodiment illustrated in FIG. 9, the blade 14 is provided with a series of serrations 15 at its upper edge so as to better engage the molded member 18. It is considered that in certain lower performance configurations that the serrations 15 would be sufficient to interreact with the molded material of support structure 18 to permanently retain the steel runner 14 in those situations where the pin mechanism illustrated in FIG. 8 is not required. The material of the blade portion may be caused to become plastic and flow using ultrasonic welding techniques. Thus, the molten material will flow to surround the serrations and hold the runner. It will be obvious to those familiar with this art that the configuration of FIG. 9 can be manufactured and assembled much more conveniently than the configuration illustrated in FIG. 8. Various other mechanisms may be used to retain the runner 14 in the blade portion 36.

Support structure 18 may be molded in a single piece. To do so however, would require particularly sophisticated injection molding equipment capable of making enclosed structures. While this is not impossible, it may be difficult. A less complicated mold would be required if the toe enclosing portion 26 were molded as a separate piece. With this arrangement flange 24 would extend around the front of the support structure 18 and the upper edge thereof may serve as the surface for mating with the remainder of toe enclosing portion 26. The separately molded toe enclosing portion 26 could be affixed to the support structure by ultrasonic welding, hot plate welding, gluing or by using mechanical fastening means.

Figure 10:
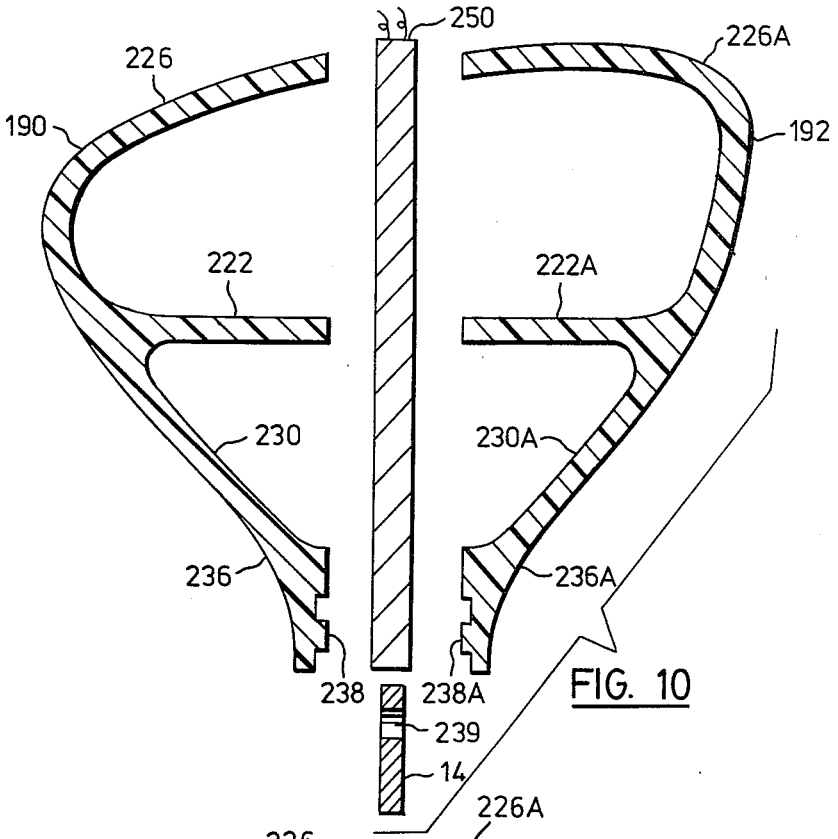
FIG. 10 illustrates a vertical cross-section through an embodiment of the runner supporting structure which is molded in halves about a vertical central line.
Figure 11:
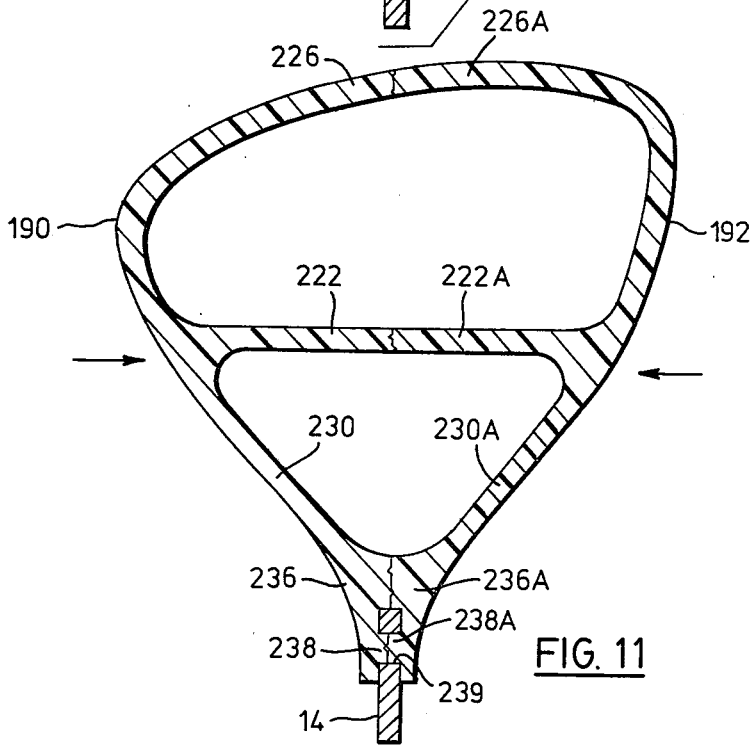
FIG. 11 illustrates the portions of FIG. 10 in the assembled condition.

As a further alternative the support structure 18 may be advantageously comprised of two "halves" joined along a centrally located vertical axis. A pair of such "halves" are shown in FIG. 10. In this particular configuration the support structure 18 comprises two halves 190 and 192 of generally similar shape. Each of the halves 190 and 192 may be separately molded. The illustration shown in FIG. 10 is a vertical section through the toe enclosing portion 26 including the first support portion 30 and the blade portion 36. Each of the molded halves 190 and 192 comprises an upper portion 226 and 226A, a substantially horizontal portion 222 and 222A, a lower support portion 230 and 230A and a blade portion 236 and 236A. In the particular configuration illustrated in FIG. 10 the blade portion 36 to be formed by the mating of portions 236 and 236A comprises a series of inwardly directed projections or lugs 238 and 238A. The steel runner 14 is shown located below the blade portions 236 and 236A and comprises a central aperture 239 into which the lugs 237 will project to locate the runner. Advantageously, the two halves 190 and 192 may be assembled using a technique known as hot plate welding illustrated in FIG. 10.

The two halves 190 and 192 are located in a movable jig means on either side of a centrally located heating means 250. The steel blade 14 is located immediately below the heater 250. Firstly, the two halves 190 and 192 are brought into contact with the heating means 250 which is raised to a sufficient temperature to heat the respective facing surfaces of portions 226 and 226A, 222 and 222A and the lugs 237 and 237A as well as portions 236 and 236A adjacent the heater 250. When all of the molded material is at a suitable temperature the portions 190 and 192 are withdrawn to either side of the heater and the heating means 250 is withdrawn vertically upwardly. The steel blade 14 is then moved upwardly between the two halves and the two halves 190 and 192 are pressed together in order to provide a permanent bond of the molten material formerly in contact with the heater 250. The material which has thus been welded with the blade 14 now located between the lugs 237 is clearly shown in FIG. 9.

While various methods have been shown for attaching the runner 14 to the blade portion 36, various other methods may be used. Ultrasonic welding may be used in place of hot plate welding. In addition, various other mechanical fastening systems may be utilized, including gluing and threaded fasteners.

I claim:

1. A skate for use as an ice skate comprising:

a rigid support structure comprising a sole portion, first and second support portions, an integral toe enclosing portion, an integral heel enclosing portion, and an integral blade portion fixed to said first and second support portions, a relatively soft, flexible sock adapted to receive a skater's foot and adapted to be affixed to said sole portion of said support structure, and a substantially rigid cover adapted to engage with said support structure to enclose and protect the skater's foot, said cover having a substantially flexible instep portion whereby a skater's ankle may flex with respect to said sole portion and having flanges adapted to extend beneath said sole portion and between said first and second support portions.

2. The skate of claim 1 wherein said cover comprises first closure means located on said flanges.

3. The skate of claim 2 wherein said cover comprises second closure means located adjacent the heel portion of said skate.

4. The skate of claim 1 wherein said sock comprises a centrally located opening adapted to open to receive said foot, said sock comprising sock closure means for closing said opening to retain said foot.

5. The skate of claim 4 wherein said blade portion comprises a substantially U-shaped channel adapted to receive a longitudinally extending generally planar runner.

6. The skate of claim 5 wherein said support structure comprises two substantially similar halves joined together along the plane of said runner.

7. The skate of claim 6 wherein said runner comprises a plurality of apertures extending through said runner transverse to said plane and said blade portion comprises lugs extending through said apertures.

8. The skate of claim 6 wherein said runner comprises serrations extending along said plane and said blade comprises material extending between said serrations.

9. The skate of claim 6 wherein said runner comprises a plurality of apertures extending through said runner transverse to said plane, and comprises metal pins extending through said apertures and through said blade portion.

10. The skate of claims 6, 7 or 8 wherein support structure is a molded thermoplastic material and said halves are joined by ultrasonic welding.

11. The skate of claim 6 wherein said first closure means of said cover comprise a lever pivotally attached to one of said flanges of said cover, a strap pivotally attached to said lever at a point eccentric from the pivotal attachment of said lever to said flange, and means located on the other of said flanges for engaging with means located on said strap, whereby when said means are engaged, pivotal movement of said lever causes said flanges to be drawn together to fix said cover to said support structure.

12. The skate of claim 11 wherein said sock is detachably secured to said support structure.

* * * * *